United States Patent [19]

Metzger

[11] 4,248,354

[45] Feb. 3, 1981

[54] ROTARY LOCKSETTING MECHANISM FOR A RIGID JAW COUPLER

[75] Inventor: William J. Metzger, Willowick, Ohio

[73] Assignee: Midland-Ross Corporation, Cleveland, Ohio

[21] Appl. No.: 63,462

[22] Filed: Aug. 3, 1979

[51] Int. Cl.³ ..... B61G 3/00

[52] U.S. Cl. ..... 213/100 W; 213/77

[58] Field of Search ..... 213/100 R, 100 W, 75 B, 213/77

[56] References Cited

U.S. PATENT DOCUMENTS

| | | | |
|---|---|---|---|
| 2,591,275 | 4/1952 | Metzger | 213/100 W |
| 2,940,610 | 6/1960 | Metzger | 213/100 W |
| 2,951,597 | 9/1960 | Metzger | 213/100 W |
| 4,203,523 | 5/1980 | DePenti | 213/100 W |

*Primary Examiner*—Randolph A. Reese

*Attorney, Agent, or Firm*—Harlan E. Hummer

[57] ABSTRACT

A Willison rigid jaw coupler with a locksetting pawl for interlockingly engaging the locklifting lever, when the lock is in lockset, is described. A special fulcrumming of the pawl is provided to cause disengagement of the pawl from the lever to allow the lock to return from lockset to the locked position.

11 Claims, 7 Drawing Figures

ROTARY LOCKSETTING MECHANISM FOR A RIGID JAW COUPLER

BACKGROUND OF THE INVENTION

The invention is an improvement in a rigid jaw car coupler which is manufactured and sold by the foundry group of the Midland-Ross Corporation of Cleveland, Ohio, under the trademark WILLISON. This coupler is primarily used on mine cars and other similar industrial applications. Rigid jaw couplers of this type utilize a locklifting lever which extends exteriorly of the coupler for operating the locking mechanism to cause disengagement of a pair of interlocked couplers. The rigid jaw couplers, unlike knuckle type couplers, do not employ a mechanism for placing the lock in a lockset position, whereby a pair of interlocked couplers can be readily disengaged. At present, an operator must be physically present to maintain the lock of at least one of a pair of interlocked rigid jaw couplers in an open position during the uncoupling operation and, if necessary, even go between a pair of coupled mine cars to operate the levers used in controlling the position of the locks for uncoupling.

U.S. Pat. No. 2,951,597 is directed to a locksetting mechanism for placing the lock of a rigid jaw coupler in a lockset position to permit subsequent disengagement of a pair of interlocked couplers. The operation of this mechanism is reliant on the use of a specially designed pawl which cooperates with the locklifting lever to hold the lock in a lockset position until the interlocked couplers are separated, after which the lock returns from lockset to a locked position. The pawl does not function as smoothly as it should, because of the frictional forces generated by the pawl as it slides up and down an inclined surface which is disposed in the bottom of the coupler head and used to cause lifting of the pawl out of interlocking engagement with the locklifting lever, as the lock moves from lockset to a locked position.

Copending Patent Application Ser. No. 916,475, filed June 19, 1978, and now U.S. Pat. No. 4,203,523 discloses a lockset mechanism which eliminates the above mentioned frictional engagement between the pawl and the coupler head. The invention of this patent application is directed to the use of a V-shaped camming arrangement on the pawl to cause lifting of the pawl out of engagement with a lug that is carried by the locklifting lever and holds the pawl and lock in lockset position. An important advantage of the invention of this particular patent application is that the lock can be returned to a locked position from lockset by forcing the lug to override the cam on the pawl. It can be appreciated by those skilled in the art that this latter feature cannot be easily obtained without sacrificing a strong, positive interlock of the lug with the cam, when the lock is in a lockset position. The present invention is an improvement of both the inventive concepts outlined above, as well as those found in U.S. Pat. Nos. 2,591,275 and 2,940,610, in that it is designed to eliminate or substantially reduce friction of contact between the pawl and the coupler head or components of the locking mechanism of the coupler, to provide an easier operating locksetting mechanism while providing a better, more positive interlock of the pawl with the locklifting lever, when the lock is in lockset.

Briefly stated, the invention is in a rigid jaw coupler having a spring biased lock, a locklifting lever for moving the lock between locked and lockset positions, and a lockset member or pawl to restrict movement of the locklifting lever and maintain the lock in a lockset position. The locklifting lever is provided with a lug which is designed to interlockingly engage an abutment that is formed in the pawl which is also provided with means for forming, adjacent the end of the pawl extending from the vertically uppermost portion of the coupler head, a fulcrum about which the pawl is caused to rotate as the lock moves from lockset to a locked position. The fulcrumming of the pawl is such that the abutment moves in a direction to cause disengagement from the lug to free the locklifting lever so that the lock can return to a locked position from lockset. The elimination of the frictional engagement between the pawl and coupler head, combined with the rotary feature of the pawl, provides a lockset mechanism which is simpler and easier to operate, while providing a positive interlock of the pawl with the locklifting lever when the lock is in a lockset position.

DESCRIPTION OF THE DRAWING

The following description of the invention will be better understood by having reference to the accompanying drawing, wherein.

DETAILED DESCRIPTION OF THE DRAWING

Figure 2:
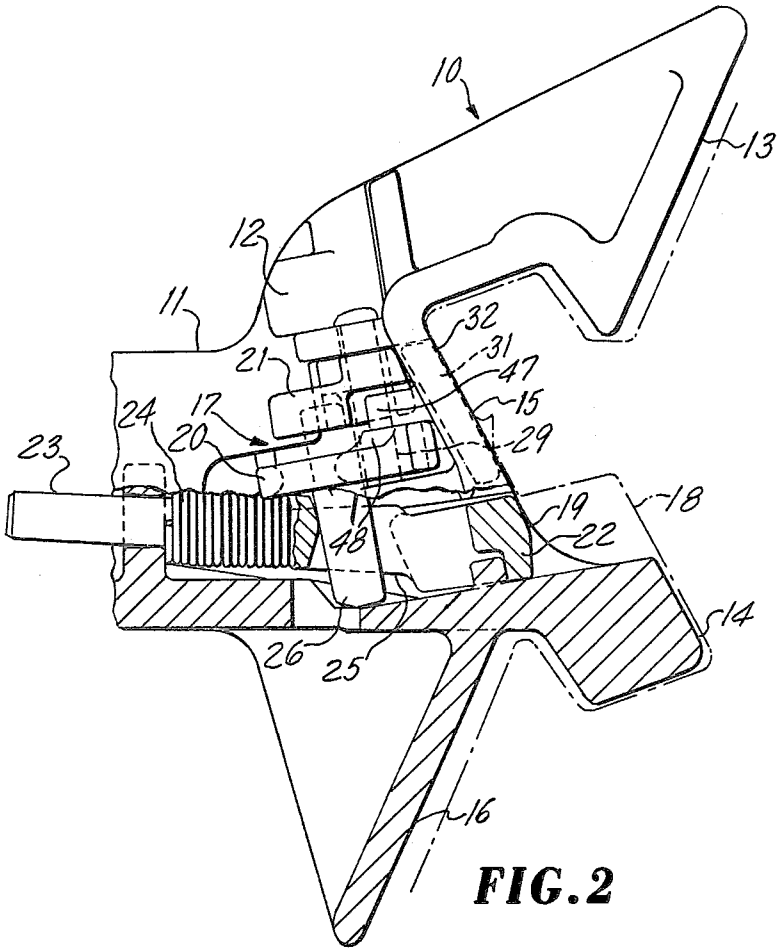
FIG. 2 is a similar plan view of the coupler portion shown partially, in section, to illustrate the locking mechanism in a lockset position.

Referring generally to the drawing, there is shown a rigid jaw coupler 10 which comprises a shank 11; a chambered head 12 including a pair of laterally spaced rigid jaws 13, 14 connected by a buffing face 15, and a guard arm 16 that extends laterally beyond the adjacent rigid jaw 14; and a locking mechanism 17 which is disposed within the chambered head 12 of the coupler 10 that is designed to engage and interlock with an opposing rigid jaw coupler 18, shown in dotted line.

Figure 1:
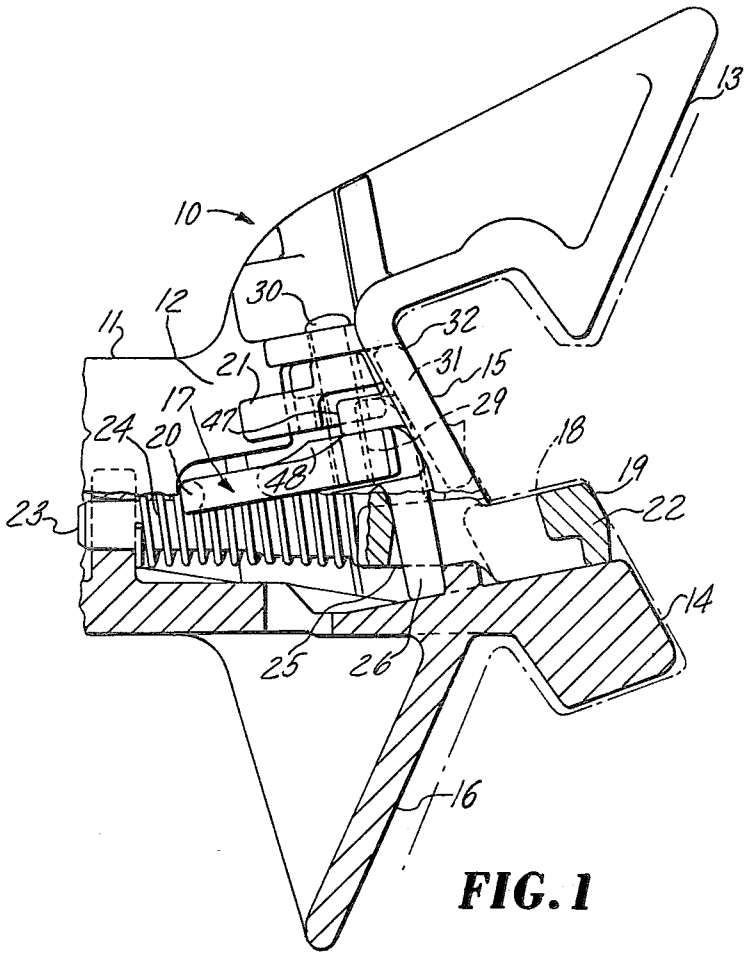
FIG. 1 is a plan view of a portion of an interlocked rigid jaw coupler which is made in accordance with the invention and shown partially, in section, to illustrate the locking mechanism in a normally locked position.
Figure 4:
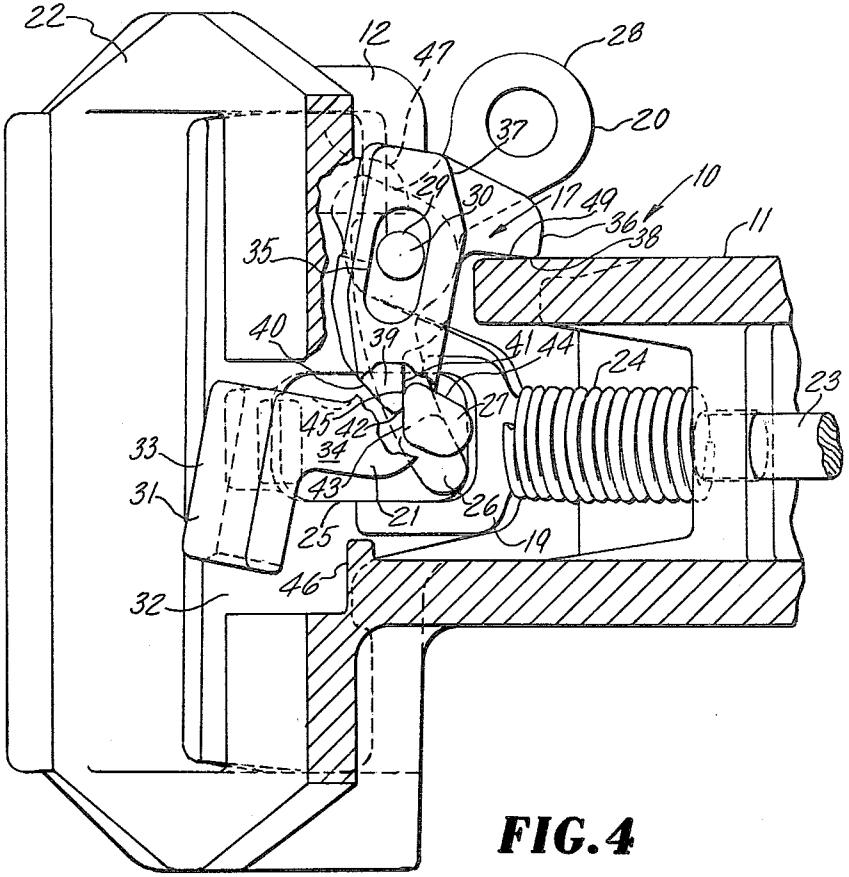
FIGS. 3–6 are side views of the coupler portion shown, in section with portions removed, to illustrate the locking mechanism in various positions from lockset to a locked position.
Figure 3:
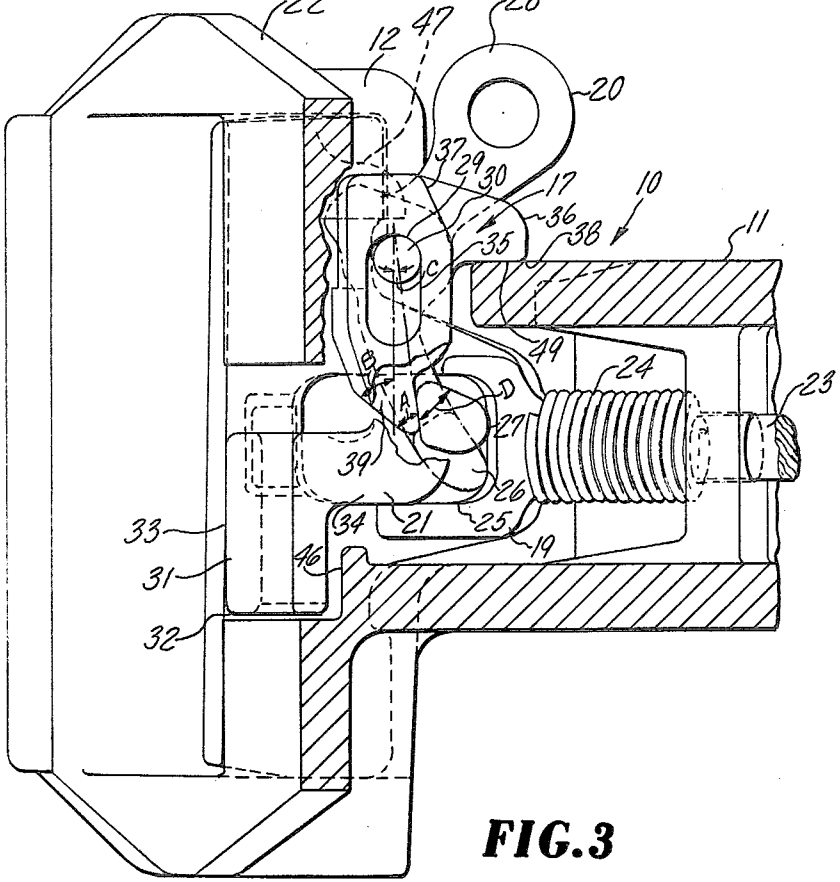
Figure 6:
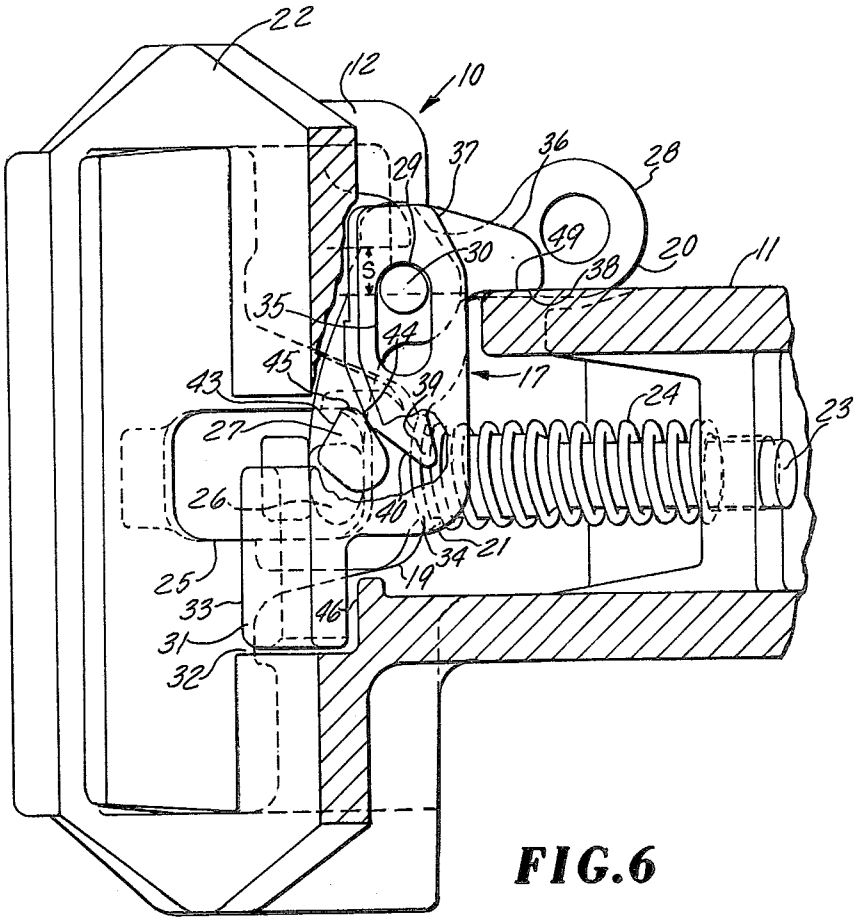
Figure 5:
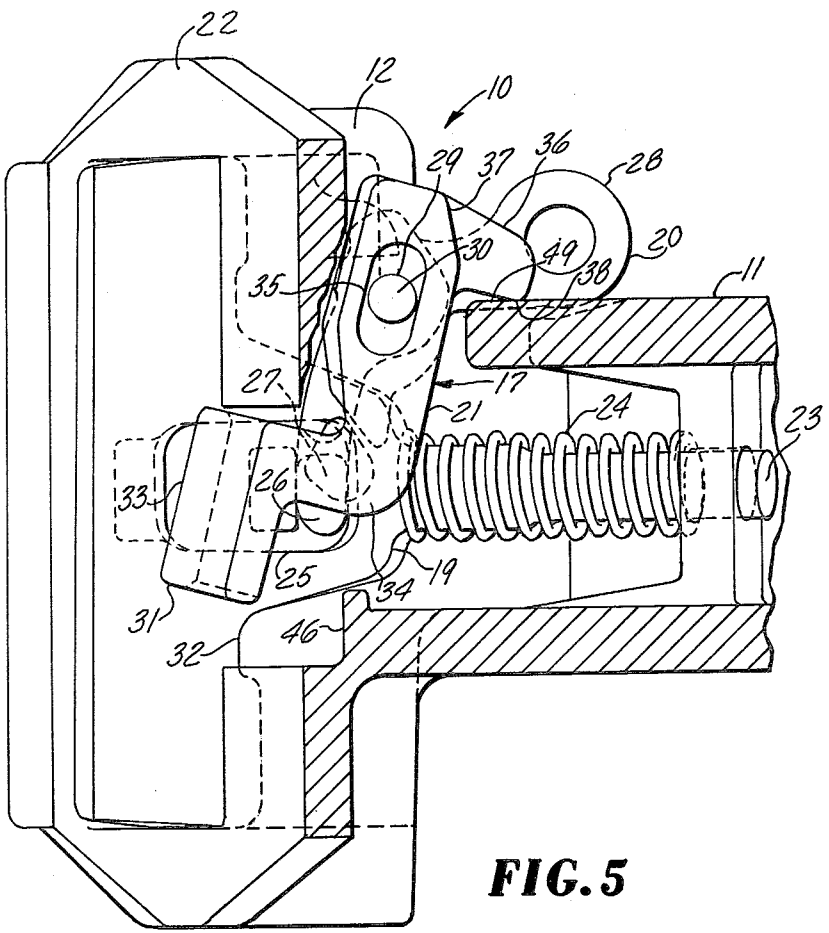
Figure 7:
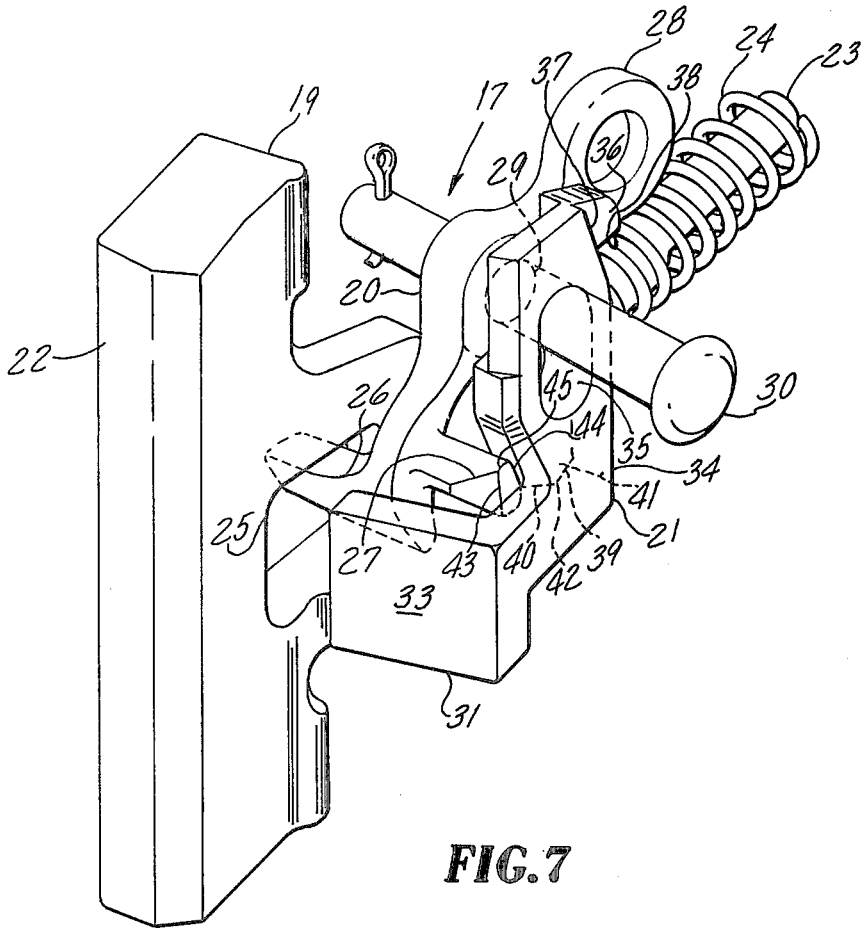
FIG. 7 is a perspective view of the locking mechanism.

The locking mechanism 17 essentially comprises a lock 19, a locklifting lever 20 for moving the lock 19 between the locked position of FIGS. 1, 6 and the lockset position of FIGS. 2, 3. A locksetting mechanism or pawl 21 is provided for restricting movement of the locklifting lever 20, when the lock 19 is in the lockset position.

The lock 19, when the coupler 10 is in a normally horizontal position as shown in FIGS. 3–6, comprises a vertically elongated bar 22 with a rearwardly extending cylindrical tail 23 that is surrounded by a coil spring 24 which biases the lock bar 22 outwardly of the buffing face 15 in a locked position adjacent the rigid jaw 14. The lock 19 is mounted within the chambered head 12 for axial movement longitudinally of the coupler 10. The lock 19 is provided with an elongated slot 25 which is horizontally disposed rearwardly of the lock bar 22 and designed to receive a rocker arm 26 that extends laterally from the locklifting lever 20.

A lug 27 is carried by the locklifting lever 20 and extends from the plane of the locklifting lever 20 in a direction opposite the rocker arm 26. The locklifting lever 20 includes an eye-shaped handle 28 which extends exteriorly of the coupler head 12 for coupling to any suitable linkage that extends, for example, to adjacent one of the sidewalls of a mine car, so that an operator can manipulate the locking mechanism 17 while standing alongside the mine car, without necessitating going between a pair of coupled cars, since such action can be hazardous to the safety of the operator. The rocker arm 26 and lug 27 are secured to the end of the locklifting lever 20 opposite the handle 28. The locklifting lever 20 is provided with a circular pin hole 29, intermediate the rocker arm 26 and handle 28, for receiving a pivot pin 30 which is carried by the coupler head 12 and to which the locklifting lever 20 is rotatably mounted.

The pawl 21 has a transversely extending plate 31 which is disposed in an opening 32 in the buffing face 15 of the coupler head 12. The plate 31 has a substantially flat front face 33 which is generally flush with the buffing face 15, when the pawl 21 is in a normally rest position where the lock 19 is in the locked or lockset positions. The pawl 21, when vertically disposed in a rest position, has a generally S-shaped body portion 34 which extends from the front plate 31 and which is provided with a vertically elongated slot 35 through which the pivot pin 30 of the coupler head 12 passes. A pivot arm or finger 36 is provided adjacent the end 37 of the pawl 21 farthest from the plate 31 and extends from the pawl 21 in a direction opposite that from which the plate 31 extends. The longitudinal axes of the elongated slot 35 and pivot arm 36 are substantially at right angles to each other. The free distal end or tip 38 of the pivot arm 36 contacts the coupler head 12 adjacent the handle 28 of the locklifting lever 20 and provides a fulcrum around which the pawl 21 rotates as the lock 19 moves from lockset to a locked position. The pivot arm 36 of the pawl 21 is of such a length that the rotation of the pawl 21 about the fulcrum or tip 38 thereof has a lifting effect upon the pawl 21 to allow disengagement of the lug 27 therefrom, so that the lock 19 is free to move from lockset back to a locked position.

The pawl 21 is provided, intermediate the plate 31 and elongated slot 35, with a generally downwardly projecting V-shaped cam 39 which is formed by a pair of front and rear camming surfaces 40, 41 which are substantially planar and converge in a direction away from the elongated slot 35 and terminate in a rounded peak 42. The front surface 40 of the cam 39 faces and is closest the buffing face 15 of the coupler 10, whereas the rear surface 41 faces away and is farthest from the buffing face 15. The included angle A (FIG. 3) between intersecting planes containing the front and rear camming surfaces 40, 41 is preferably 40–50 degrees for best results, and the included angle B between intersecting planes containing the front camming surface 40 and the longitudinal axis of the elongated slot 35 is preferably 50–60 degrees for best results. The rear camming surface 41 acts as a flat abutment against which the lug 27 of the locklifting lever 20 comes to rest, when the lock 19 is in lockset. The rear camming surface or abutment 41 of the pawl 21, when in a normally rest position, can be substantially normal to the direction which the lock 19 reciprocates between lockset and the locked position, but for best results, the rear camming surface 41 is slightly inclined in a direction opposite that disclosed in the aforementioned copending application, to provide a more positive interlock between the lock 19 and pawl 21, when the lock 19 is in lockset. The included angle C between intersecting planes containing the longitudinal axis of the elongated slot 35 and the rear camming surface or abutment 41, is between 0–15 degrees and preferably about 8–10 degrees, and the plane containing the abutment 41, diverges rearwardly from the plane containing the longitudinal axis of the elongated slot 35 in a direction away from the elongated slot 35.

The lug 27 of the locklifting lever 20, when in the locked position of FIG. 6, comprises front and rear flat camming faces 43, 44 which converge in the direction of the adjacent cam 39 of the pawl 21 and terminate in a rounded point 45 which faces upwardly towards the handle 28 of the locklifting lever 20. The included angle D between planes containing the front and rear camming faces 43, 44 of the lug 27 is 50–60 degrees for best results. The front camming surface 40 of the pawl 21 and the rear camming face 44 of the lug 27 are so inclined that upon coaction, as the lug 27 moves rearwardly by the operation of the locklifting lever 20, the lug 27 will lift the pawl 21 vertically upwards, so that the lug 27 can override and bypass the cam 39 and come to rest in a position where the front camming face 43 of the lug 27 abuts the abutment or rear camming surface 41 of the pawl 21, when the pawl 21 drops back to its normal rest position of FIG. 3. The pivot arm 36 is substantially in the plane of contact between the lug 27 and cam 39 to prevent twisting of the pawl 21 out of a desired rotational plane.

Thus, the lock 19 is caused to move from a locked position to lockset. It is the unique fulcrumming of the locklifting lever 20, however, which lifts the pawl 21 on the return of the lock 19 from lockset to a locked position, to cause disengagement of the lug 27 and abutment 41. The camming action of the rear camming face 44 of the lug 27 against the front camming surface 40 of the pawl 21, causes the pawl 21 to drop to its normal rest position when the lock 19 returns to its locked position.

OPERATION OF THE LOCKING MECHANISM

For the purpose of this discussion, it will be assumed that the lock 19 is biased outwardly of the coupler head 12 in the locked position of FIGS. 1 and 6, where the handle 28 of the locklifting lever 20 is generally horizontal adjacent the coupler shank 11, and the plate 31 of the pawl 21 is restricted to vertical movement by the opposing coupler 18 and a rearwardly spaced stop 46 which is formed in the coupler head 12 in spaced relation from the buffing face 15.

An operator, desiring to uncouple the pair of interlocked couplers 10, 18, actuates the linkage bars coupled to the handle 28 of the locklifting lever 20 to rotate the handle 28 towards the lock bar 22 or, as seen in FIGS. 6 and 3, in a counterclockwise direction about the fixed pivot pin 30. The rocker arm 26 carried by the locklifting lever 20 acts against the lock 19 to move it rearwardly into more biased relation with the coil spring 24. Simultaneously, the lug 27 of the locklifting lever 20 slidably engages the front camming surface 40 of the cam 39, causing the pawl 21 to move vertically. When the handle 28 of the locklifting lever 20 is rotated to its vertically foremost position, as seen in FIG. 3, the rocker arm 26 moves the lock 19 to its farthest rearwardly position, or the lockset position. The lug 27 of the locklifting lever 20 passes beyond the V-shaped cam 39, or rounded juncture of the intersecting front and rear camming surfaces 40, 41 to a position which allows the pawl 21 to drop vertically back to its normal rest position, where the lug 27 of the locklifting lever 20 comes to rest against the abutment 41 of the pawl 21. The lock 19 and locking mechanism 17 are now in a lockset position where the opposing coupler 18 can be subsequently easily disengaged without danger to the operator.

Immediately upon disengagement of the couplers 10,18 and the removal of the rearwardly directed force against the plate 31 by the opposing coupler 18, the coil spring 24 reacts to move the lock 19 forwardly back to its locked position, as seen in FIGS. 3–6. The lock 19 forces the lug 27 outwardly in the direction of the buffing face 15 of the coupler head 12. The lug 27, in turn, pushes against the pawl 21 causing it to rotate about the tip 38 of the pivot arm 36 to cause movement of the cam 39 of the pawl 21, upwardly out of disengagement with the lug 27 which, upon being freed, moves frequently of the front camming surface 40 of the cam 39 to a position where the raised pawl 21 is free to drop, by gravity, back to its normal rest position. If for any reason it is desired to return the couplers 10,18 to their interlocked positions, the handle 28 of the coupler 10 is rotated back away from the lock bar 22 to cause disengagement of the locklifting lever 20 and pawl 21, as described above, whereby the lock 19 of the coupler 10 moves from lockset back to interlocking relation with the lock of the other coupler 18.

The coupler head 12 is provided with a fixed parting wall 47 which extends between, and separates, the locklifting lever 20 from the pawl 21, so that the locklifting lever 20 can never bind against the pawl 21 and hinder its operation, even when the locklifting lever 20 of a coupler in an angled position, is operated. The wall 47 is designed to contact a laterally extending side projection 48 on the locklifting lever 20, and is spaced a distance S above the adjacent upper surface 49 of the coupler head 12 sufficient to permit easy angled insertion of the locklifting lever 20 into position in the coupler head 12. The wall also helps to close the top opening in the coupler head 12 to prevent dirt and other debris from falling into the interior of the coupler head 12.

Thus, there has been provided a rigid jaw type coupler having a highly improved locking mechanism which provides a positive interlock of the locksetting pawl with the locklifting lever while eliminating frictional coaction between the locksetting pawl and the coupler head to provide a simplified and easier operating mechanism.

What is claimed is:

1. A coupler having a shank extending from a chambered head with a buffing face that connects a pair of laterally spaced fixed jaws, and a locking mechanism which comprises:

(a) a spring biased lock disposed within the chambered head and movable generally longitudinally of the coupler shank between a locked position and a lockset position, the lock having an axially elongated slot therein;

(b) a locklifting lever for moving the lock between the locked and lockset positions, the lever having a pair of opposing ends;

(c) means mounting the lever on the coupler head for limited rotation about an axis which is normal to the direction in which the lock moves between the positions;

(d) a handle at one of the opposing ends of the lever and disposed exteriorly of the coupler head for operating the lever;

(e) a lug and rocker arm disposed within the chambered head at the other of the opposing ends of the lever, the lug and arm extending in opposite directions from the plane of the lever, the rocker arm being received in the slot of the lock and designed to move the lock axially against the lock biasing spring, when the handle of the lever is rotated in one direction to operate the lever;

(f) a pawl for engaging the lug and holding the lock in the lockset position, the pawl having a plate at one end of a pair of opposing ends thereof for receipt in an opening disposed in the buffing face of the coupler adjacent the lock, the pawl including, (i) an abutment for coming to rest in interlocking engagement with the lug when the lock is moved by the lever to the lockset position, and (ii) means for forming a fulcrum, adjacent the other end of the pair of opposing ends of the pawl, around which the pawl rotates in a plane normal to the rotational axis of the lever as the lock moves from the lockset position to the locked position, the fulcrumming of the pawl being such that the abutment moves in a direction to cause disengagement from the lug as the pawl rotates; and (g) means mounting the pawl for limited movement in an angular direction relative to the direction in which the lock moves between the positions.

2. The coupler of claim 1, wherein the lever mounting means (c) includes a pivot pin secured to the chambered head, and a pin hole extending transversely through the lever intermediate opposing ends thereof for receipt of the pivot pin.

3. The coupler of claim 2, wherein the pawl mounting means (g) includes, (i) an elongated slot disposed in the pawl adjacent the end thereof opposite the plate, for receiving the pivot pin, and (ii) means for helping restrict movement of the plate in a direction which is normal to the direction in which the lock moves between the positions.

4. The coupler of claim 3, wherein the pawl includes a generally V-shaped cam positioned between the plate and elongated slot, the cam having a pair of camming surfaces which converge towards a rounded peak therebetween and in a direction away from the elongated slot, one of the camming surfaces farthest from the plate being the abutment for engaging the lug, the other of the camming surfaces designed to slidably engage the lug as the lug moves in a direction away from the plate, the coaction of the lug with the other camming surface causing movement of the cam in the direction of the handle.

5. The coupler of claim 4, wherein the one camming surface forming the abutment is substantially parallel to the longitudinal axis of the elongated slot of the pawl.

6. The coupler of claim 4, wherein the included angle (C) between intersecting planes containing the abutment and the longitudinal axis of the elongated slot is in the range of from 0–15 degrees, when the coupler is in a lockset position, and the planes diverge in a direction away from the slot.

7. The coupler of claim 6, wherein the included angle (C) is about 10 degrees.

8. The coupler of claim 6, wherein the fulcrumming forming means (ii) comprises a pivot arm extending from the pawl in a direction from the slot therein opposite from which the plate extends, the pivot arm having a tip which engages the coupler head adjacent the handle, the point of contact of the tip of the pawl with the coupler head being offset from the longitudinal axis of the slot in the pawl such that the cam will move in a disengaging direction from the lug as the pawl rotates.

9. The coupler of claim 1, which includes means fixedly disposed between the pawl and lever in spaced relation above an adjacent top surface of the coupler head for separating the pawl and lever so that the lever will not bear against and hinder functioning of the pawl.

10. A coupler having a shank extending from a chambered head with a buffing face that connects a pair of laterally spaced fixed jaws, and a locking mechanism which comprises:

(a) a lock disposed within the chambered head and movable generally longitudinally of the coupler shank between a locked position and a lockset position, the lock including an elongated bar with a cylindrical tail extending therefrom and having an axially elongated slot therein;

(b) means for biasing the lock in a direction outwardly of the buffing face in a direction away from the shank;

(c) a locklifting lever for moving the lock between the locked and lockset positions, the lever having a pair of opposing ends;

(d) means mounting the lever on the coupler head for limited rotation about an axis which is normal to the direction in which the lock moves, including a pivot pin carried by the coupler head and a pin hole disposed in the lever between opposing ends thereof for receipt of the pivot pin;

(e) a handle at one of the opposing ends of the lever and disposed exteriorly of the coupler head for operating the lever;

(f) a lug and rocker arm disposed within the chambered head at the other of the opposing ends of the lever, the lug and arm extending in opposite directions from the plane of the lever, the arm being received in the slot of the lock and designed to move the lock axially against the lock biasing means, when the handle of the lever is rotated in one direction to operate the lever, the lug having a pair of front and rear camming faces which converge in the direction of the handle when the lock is in a locked position, the converging camming faces being generally flat and terminating in a rounded point and the included angle (D) between intersecting planes containing the faces being in the range of from 50–60 degrees;

(g) a pawl for engaging the lug and holding the lock in the lockset position, the pawl having a plate at one end of a pair of opposing ends thereof for receipt in an opening disposed in the buffing face of the coupler adjacent the lock, the pawl having an elongated slot between opposing ends thereof for receipt of the pivot pin, the pawl including; (i) a cam positioned between the plate and elongated slot and having front and rear camming surfaces which converge in a direction away from the slot and terminate at a rounded peak, the included angle (A) between intersecting planes containing the surfaces being in the range of from 40–50 degrees, the included angle (C) between intersecting planes containing the rear camming surface and longitudinal axis of the slot being in the range of from 0–15 degrees, the rear camming surface acting as an abutment which comes to rest in interlocking engagement with the lug when the lock is moved by the lever to the lockset position; and (ii) means for forming, adjacent the other end of the pair of opposing ends of the pawl, a fulcrum around which the pawl rotates as the lock moves from a lockset position to a locked position, the fulcrumming of the pawl being such that the cam moves generally in the direction of the handle as the pawl rotates, to cause disengagement of the lug and abutment.

11. The coupler of claim 9, wherein the fulcrum forming means includes a pivot arm extending from the pawl in a direction from the slot therein opposite that in which the plate extends, the pivot arm having a rounded tip in spaced relation from the longitudinal axis of the elongated slot for contacting the coupler head adjacent the handle, when the handle is in a rest position where the lock is in a locked position.

* * * * *